US006685264B2

(12) United States Patent
Mullen et al.

(10) Patent No.: US 6,685,264 B2
(45) Date of Patent: Feb. 3, 2004

(54) ARTICULATING TRAY

(76) Inventors: Paul T. Mullen, 55 Green Vally Drive, Suite 1712, Kitchener, ON (CA), K6V 2X2; Jean Marc Girardin, 4000NE 168th St., #105, North Miami Beach, FL (US) 33160

( * ) Notice: Subject to any disclaimer, the term of this patent is extended or adjusted under 35 U.S.C. 154(b) by 0 days.

(21) Appl. No.: 10/189,552

(22) Filed: Jul. 8, 2002

(65) Prior Publication Data

US 2004/0004372 A1 Jan. 8, 2004

(51) Int. Cl.[7] ..... A47C 7/70

(52) U.S. Cl. ..... 297/173; 297/170; 297/188.15; 297/188.18

(58) Field of Search ..... 297/435, 162, 297/170, 173, 188.18, 188.2, 188.21, 174, 155, 188.15

(56) References Cited

U.S. PATENT DOCUMENTS

| | | | | | |
|---|---|---|---|---|---|
| 289,384 | A | * | 12/1883 | Byrkit | 297/170 |
| 389,952 | A | * | 9/1888 | Byrkit | 297/170 |
| 818,917 | A | * | 4/1906 | Ruger | 297/173 |
| 2,710,051 | A | * | 6/1955 | Greenberg | 297/170 |
| 3,215,467 | A | | 11/1965 | McFarland | |
| 3,522,887 | A | | 8/1970 | Peterson | |
| 3,870,362 | A | | 3/1975 | Large | |
| 4,458,870 | A | | 7/1984 | Duncan | |
| 4,878,685 | A | * | 11/1989 | Bahm | 297/162 |
| 4,944,552 | A | * | 7/1990 | Harris | 297/145 |
| 5,653,499 | A | * | 8/1997 | Goodall | 297/170 |
| 5,899,526 | A | * | 5/1999 | LaPointe et al. | 297/173 |
| 6,412,738 | B1 | * | 7/2002 | Bressler et al. | 297/173 |

* cited by examiner

*Primary Examiner*—Peter R. Brown
(74) *Attorney, Agent, or Firm*—Ralph A. Dowell; Dowell & Dowell P.C.

(57) ABSTRACT

An articulating tray assembly for mounting on a support member, such as a wheelchair side frame member, which can be self stored and moved from the storage position to an operating position either inside or outside of the support member by manipulation of a single clamping knob. Forward and rearward movement of the tray is controlled by a second clamping knob.

8 Claims, 6 Drawing Sheets

ARTICULATING TRAY

FIELD OF INVENTION

This invention relates to an adjustable tray for attachment to a wheelchair, hospital bed, airline seat or the like, having a vertical or horizontal support member.

BACKGROUND OF INVENTION AND PRIOR ART

Numerous tray and table arrangements for attachment to wheelchairs, airline and other transportation system seats and the like have been developed. Attention is directed, in part, to such U.S. Pat. Nos. as 3,215,467; 4,458,870; 3,870, 362 and 3,522,887, all of which describe attachments to a seat arm for a wheelchair and which may include a tray table. Some of these attachments provide for vertical, horizontal and angular adjustments of a generalized nature but not for forward and rearward or rotational movement in a horizontal plane relative to the wheelchair occupant. Furthermore, the prior art attachments generally require numerous control knobs to effect adjustments, which may be difficult for physically challenged wheelchair or hospital bed occupants to manipulate. There remains, therefore, a need for a simplified articulating tray which is fully adjustable in a multi-directional manner including vertical, horizontal (forward and backward) and rotational movement to accommodate a wide range of functions and user body types, with a minimum of position adjustment controls, preferably no more than two. Preferably, the tray can easily be swung away from the occupant when not in use and stored in a vertical plane which utilizes minimal space. It is also desirable that the tray should be "unhanded", i.e. mountable on either left or right without modification, and also easily mountable and dismountable without the use of tools, and without modification to the wheelchair or hospital bed or the like.

OBJECT OF INVENTION

Thus, it is an object of the present invention to provide an articulating tray arrangement for attachment to a support member that is fully articulating vertically, horizontally and rotationally using only two adjustment controls, that can be mounted, or dismounted from, on either side of a wheelchair or the like without the use of tools.

BRIEF STATEMENT OF INVENTION

By one aspect of this invention there is provided a tray assembly, for attachment to a support member, comprising:

(a) a planar tray surface;

(b) support arm means pivotally connected to said planar tray surface; and (c) connecting means for releasably and rotatably securing said support arm means to said support member; wherein said connecting means comprises first clamping means to rotatably and slidably receive said support arm means for vertical and linear movement, and rotational movement about a vertical axis when said planar table surface is in a horizontal operative position, and for rotational movement about a horizontal axis so as to move said support arm means from a vertical operative position to a horizontal storage position, and to clamp said support arm means in any selected position; and second clamping means releasably and rotatably connected to said first clamping means for releasably securing said first clamping means to said support member.

DETAILED DESCRIPTION OF PREFERRED EMBODIMENT

Figure 1:
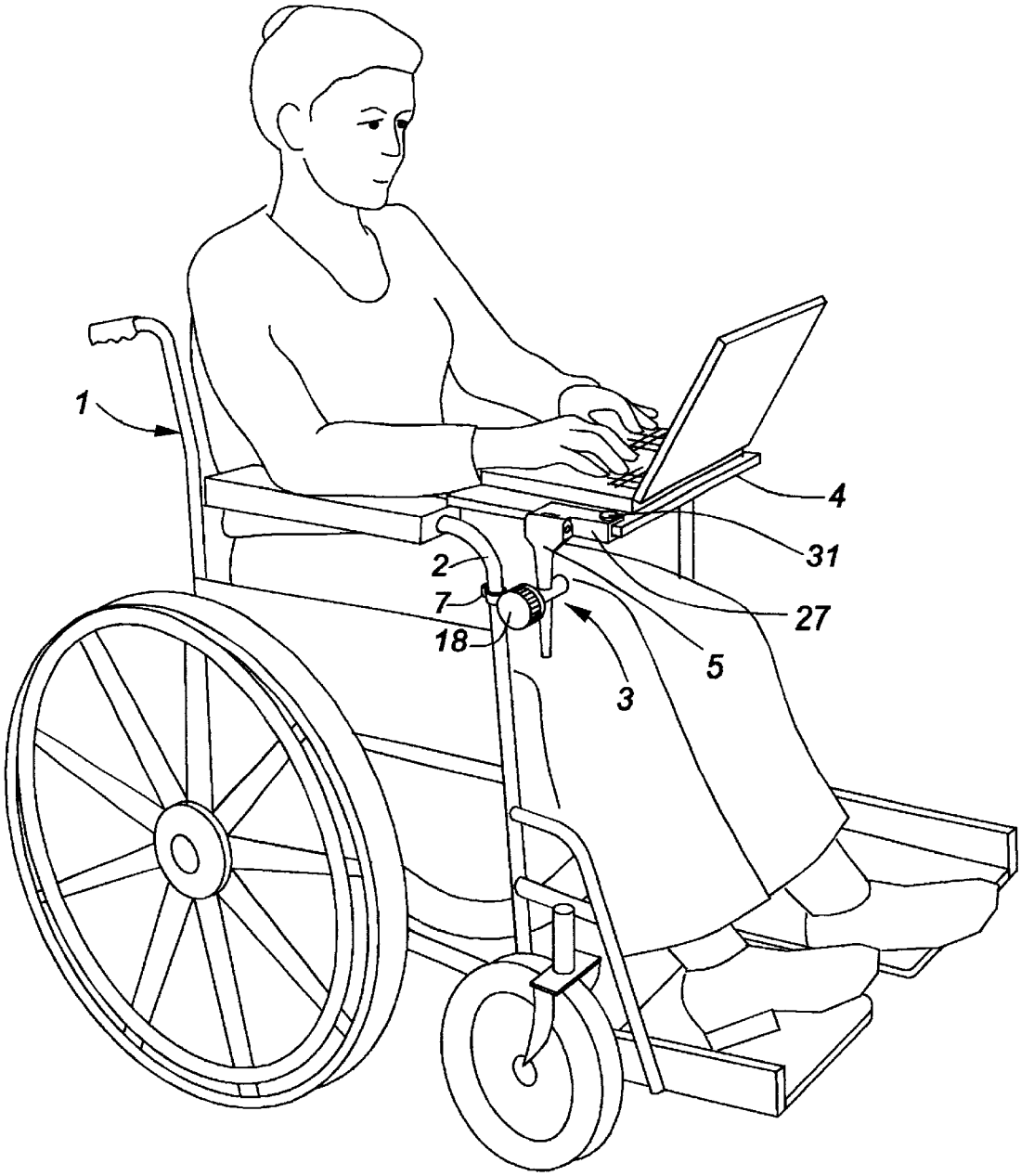
FIG. 1 is an isometric view of a wheelchair provided with an adjustable tray according to one embodiment of the present invention.
Figure 2:
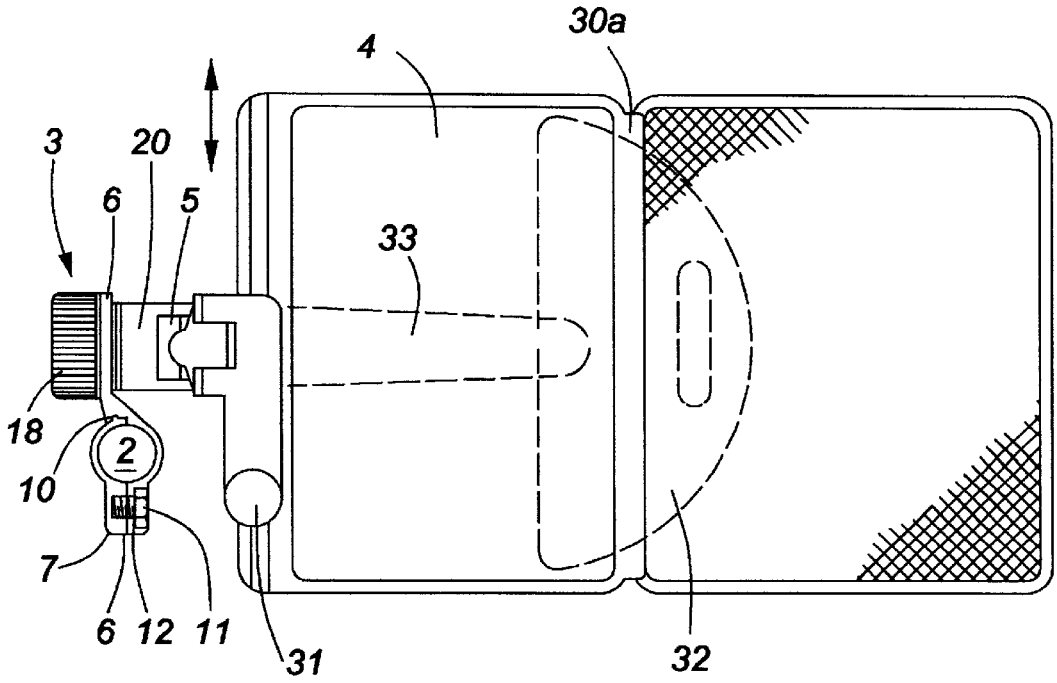
FIG. 2 is a plan view of the tray and adjusting mechanism assembly of FIG. 1.
Figure 3:
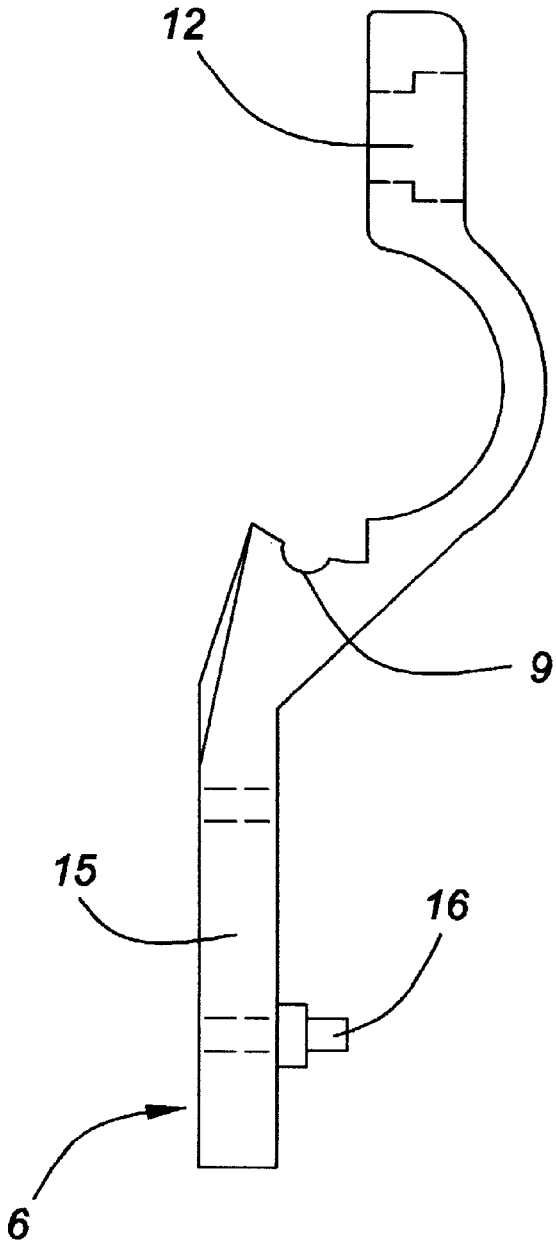
FIG. 3 is a top view of a female clamp casting.
Figure 4:
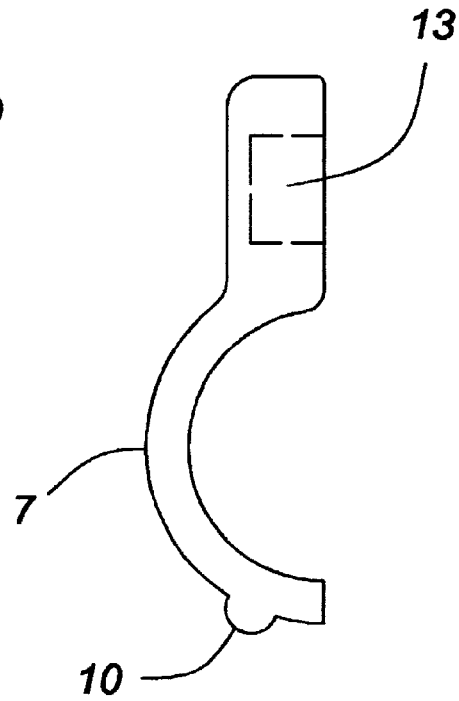
FIG. 4 is a top view of a male clamp casting.
Figure 5:
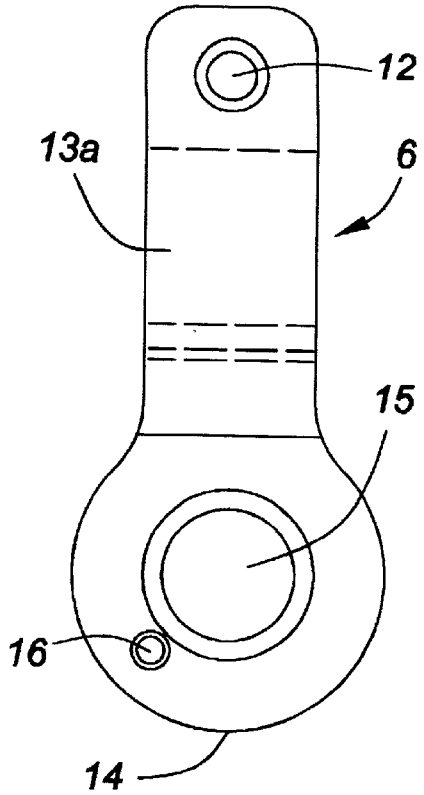
FIG. 5 is a side view of the female clamp casting of FIG. 3.
Figure 6:
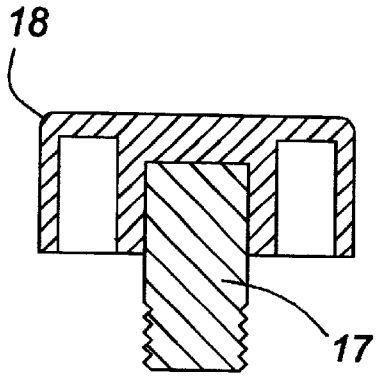
FIG. 6 is a front sectional view of a lock knob assembly.
Figure 7:
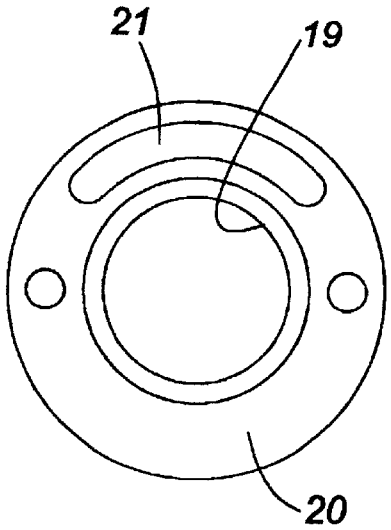
FIG. 7 is a front view of a clamp block assembly.
Figure 8:
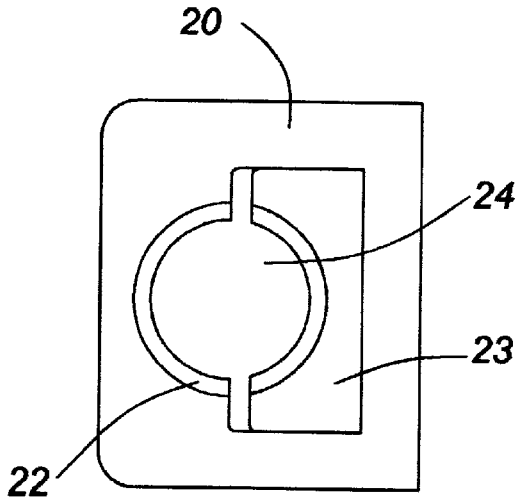
FIG. 8 is a plan view of the clamp block assembly of FIG. 7.
Figure 9:
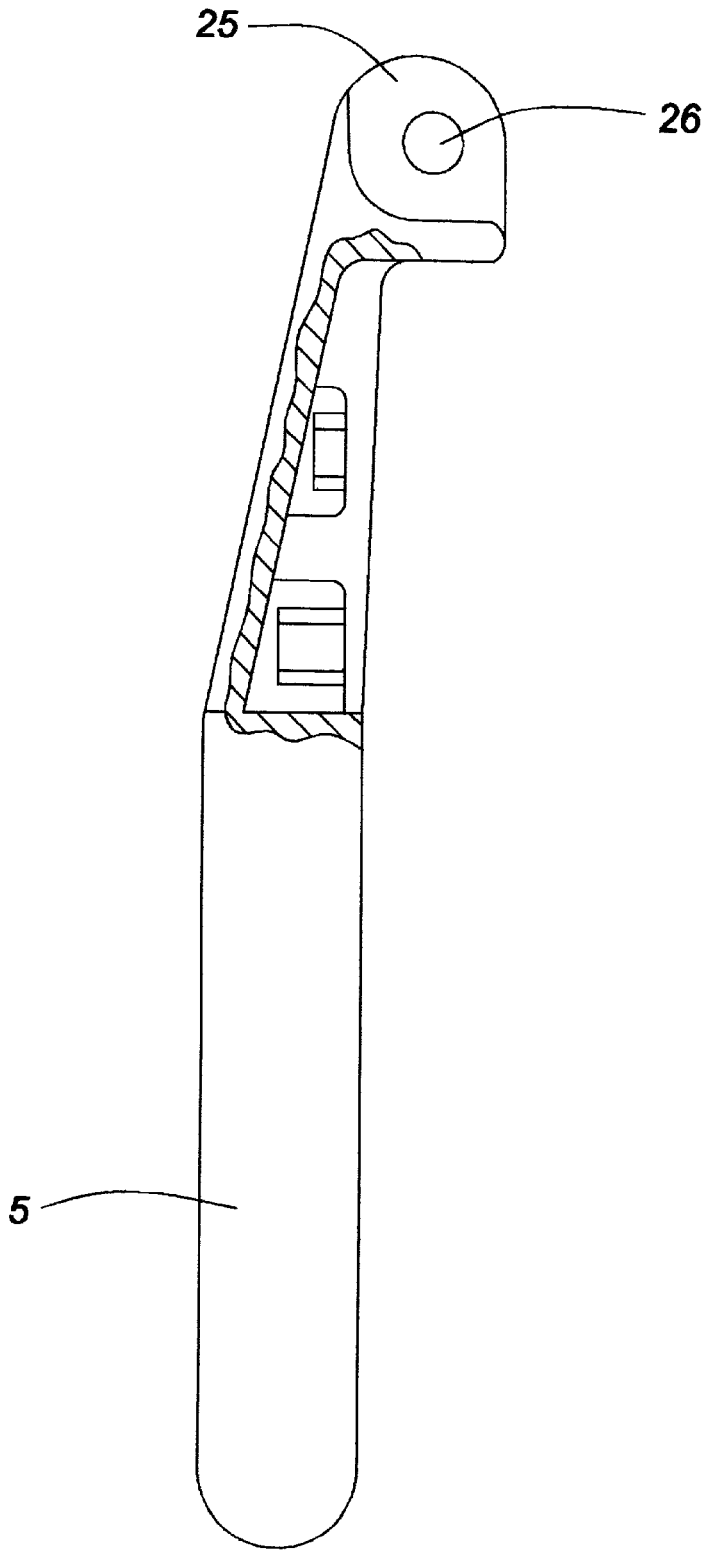
FIG. 9 is a side view of a tilt arm casting.
Figure 10:
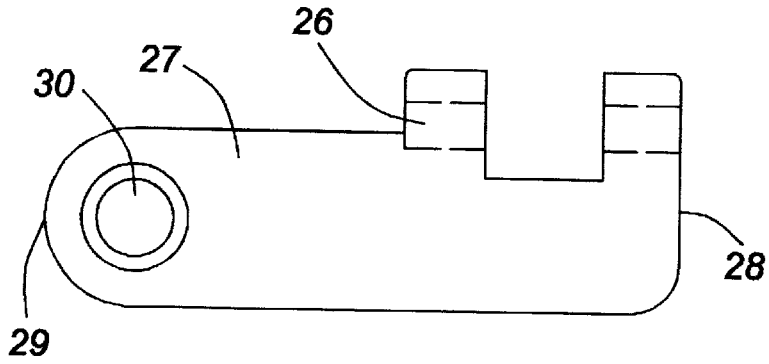
FIG. 10 is a plan view of a tray glide casting assembly.
Figure 11:
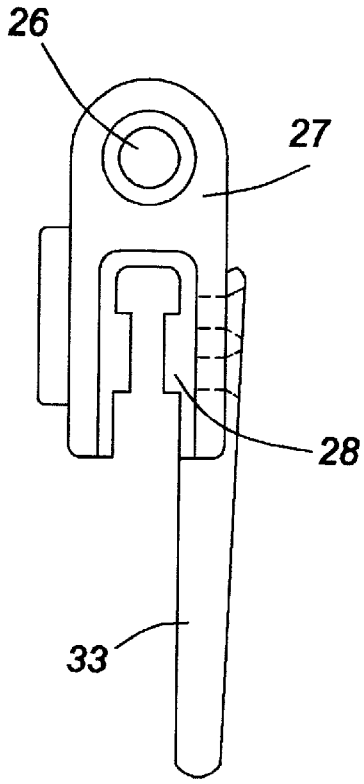
FIG. 11 is an end view of the table glide casting assembly of FIG. 10.
Figure 12:
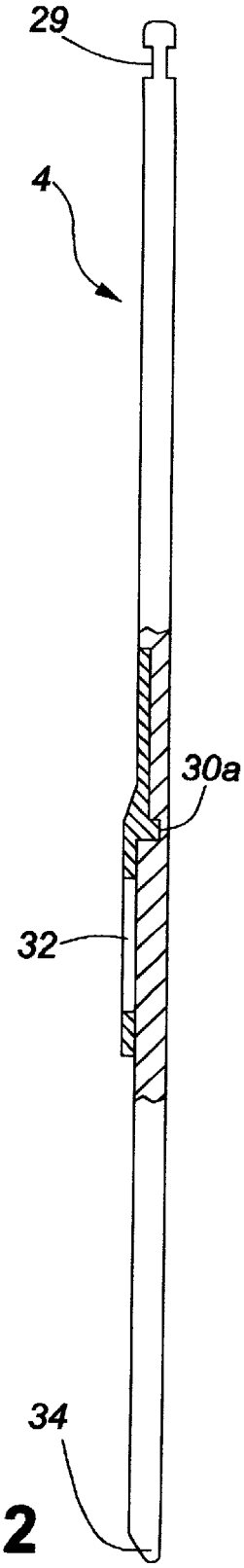
FIG. 12 is a side view of a tray for attachment to the glide casting assembly of FIG. 10.

In FIG. 1 there is shown a wheelchair 1 to which a tilt and adjustment mechanism 3 is attached to an arm 2 thereof. A tray 4 is mounted to mechanism 3 by means of vertical arm 5 adjustably mounted on mechanism 3. As seen more clearly in FIG. 2, the tilt and adjustment mechanism 3 is mounted on arm 2 of wheelchair 1 by means of a clamp assembly comprising a cast female clamp element 6 (FIG. 3) and a cast male clamp element 7 (FIG. 4). As seen in FIG. 3, cast female clamp element 6 is provided with a recess 9 adapted to receive a projection 10 on male clamp element 7. Elements 6 and 7 are clampingly secured around arm 2 by means of a headed threaded bolt 11 which passes through hole 12 in element 6 and engages the threads in recess 13 in element 7 (as seen in FIG. 2). Female casting 6 is provided with an arm 13*a* terminating at the distal end 14 thereof with a circular section having a hole 15 therethrough and a projecting pin 16 extending perpendicularly from the face thereof. The clamp mechanism 3 also includes a threaded bolt 17 (FIG. 6), having a knurled head or knob 18, which passes through hole 15 in female element 6 and engages threads 19 in clamp block 20 (FIG. 7). Clamp block 20 is provided with an arcuate slot 21 adapted to receive pin 16 of element 6 so as to provide limited relative movement therebetween. Block 20 is usually, but not essentially, provided with a resilient nylon (or other suitable thermoplastics material) bearing sleeve 22, held in place by cover plate 23 which is releasably secured to block 20 by screws (not shown). Sleeve 22 provides a circular hole 24 perpendicular to threaded hole 19 so that when bolt 17 is tightened in hole 19 it will press against sleeve 22 and reduce the diameter thereof slightly. Arm 5 (FIG. 9) is slidably and rotatably mounted in hole 24 and can be adjustably secured vertically therein by tightening knob 18. It will be appreciated that, by virtue of arcuate slot 21 and pin 16, arm 5 may be tilted backwards, about a horizontal axis, from the operative vertical and tilt position to the horizontal storage position before knob 18 is tightened. Arm 5 can be rotated about a vertical axis so as to swing table 4 in front of, or to the side of the wheelchair occupant. When rotated to the side of the occupant, tray surface functionality is provided without obstruction of the space immediately in front of the occupant. At the upper end of arm 5 there is provided a hinge pivot 25 adapted to receive a horizontal pivot pin 26 so as to pivotally attach a table glide casting 27 (FIG. 10) thereto at one end 28 thereof. At the other end 29, there is provided a threaded hole 30 to receive tray clamping knob 31. As seen in FIG. 11, the table glide casting 27 is also provided with a nylon glide insert 28 adapted to slidably receive a complementary shaped end 29 (FIG. 12) of a folding tray 4 and a support arm casting 33 (FIGS. 2 and 11).

Preferably, but not essentially, tray 4 is provided with an integral hinge 30*a* so that end 31 can be lifted and folded so as to overlie end 29. If such a hinge is provided, it may also be advantageous to provide a hinge stabilizer 32, so as to prevent sagging of the unsupported end 34 of the tray 4 and to provide a grab handle for tray assembly position articulation.

It will be appreciated that, in operation, the tray 4 can be placed in front of the occupant or rotated 360° about a vertical axis without further knob adjustment once knob 18 is initially tightened to an appropriate tension. This facilitates operation by a physically challenged user. The vertical height of the tray 4 can be adjusted by simply loosening the one knob 18 and subsequently retightening when the tray 4 is repositioned. Tilt adjustment can also be accomplished without further knob adjustment once the knob is initially tightened to an appropriate tension. The lateral fore and aft position of the table is simply adjusted by means of knob 31. Once the knob 31 is appropriately tensioned, fore and aft positioning of the tray does not require further knob adjustment as the tray will maintain its position. Knob 31 is fully tightened only if full locking of the fore and aft position of the tray is required. When the tray is not in use, it is merely necessary to raise tray 4, about pivot pin 26, release knob 18 to adjust vertical length to suit wheelchair size, and rotate arm 5 about its horizontal axis from the vertical to the horizontal position to the extent of slot 21 so that the tray 4 is now in a storage position in a plane parallel to the plane of the arm 2 of the wheelchair. It will also be appreciated that the tray assembly of the present invention may be installed, without the use of tools or modification, once the basic mounting clamp is installed (FIGS. 3 and 4), on either the left or right hand sides of the wheelchair, thereby minimizing the number of parts required and hence reducing manufacturing and distribution costs. It will also be appreciated by those skilled in the art that while this invention has been described with particular reference to attachment to a wheelchair, the invention is not limited thereto, as the tray of this invention can equally well be attached to a frame member of a hospital bed, an airline, bus or train seat or any other form of seating having a frame member to provide support therefor.

We claim:

1. A tray assembly, for attachment to a support member, comprising:

(a) a planar tray surface;

(b) support arm means pivotally connected to said planar tray surface; and (c) connecting means for releasably and rotatably securing said support arm means to said support member; wherein said connecting means comprises first clamping means to rotatably and slidably receive said support arm means for vertical and linear movement, and rotational movement about a vertical axis when said planar tray surface is in a horizontal operative position, and for rotational movement about a horizontal axis so as to move said support arm means from a vertical operative position to a horizontal storage position, and to clamp said support arm means in any selected position; and second clamping means releasably and rotatably connected to said first clamping means for releasably securing said first clamping means to said support member.

2. A tray assembly as claimed in claim 1 wherein said planar tray surface is slidably connected to said support arm means.

3. A tray assembly as claimed in claim 2 including third clamping means mounted on said support arm means to releasably secure said planar tray surface in any selected position relative to an occupant.

4. A tray assembly as claimed in claim 1 wherein said planar tray surface comprises a pair of hingedly interconnected planar tray surfaces arranged so that one said tray surface may be placed in overlying planar relationship to the other said tray surface when in closed position, and in a single plane when in an open position.

5. A tray assembly as claimed in claim 4 including hinge stabilization means so as to maintain said planar tray surfaces in a single horizontal plane.

6. A tray assembly as claimed in claim 1 wherein said first clamping means includes rotatable knob means to clamp said arm means in said selected position.

7. A tray assembly as claimed in claim 1 attached to said support member.

8. A tray assembly as claimed in claim 7 wherein said support member comprises a wheelchair side frame member.

* * * * *